US012116715B2

(12) United States Patent
Da Riol

(10) Patent No.: US 12,116,715 B2
(45) Date of Patent: Oct. 15, 2024

(54) LAUNDRY APPLIANCE HAVING A DRAWER PROVIDED WITH IMPROVED TOP COVER

(71) Applicant: Electrolux Appliances Aktiebolag, Stockholm (SE)

(72) Inventor: Daniele Da Riol, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 820 days.

(21) Appl. No.: 17/263,268

(22) PCT Filed: Aug. 23, 2019

(86) PCT No.: PCT/EP2019/072610
§ 371 (c)(1),
(2) Date: Jan. 26, 2021

(87) PCT Pub. No.: WO2020/043621
PCT Pub. Date: Mar. 5, 2020

(65) Prior Publication Data

US 2021/0172107 A1 Jun. 10, 2021

(30) Foreign Application Priority Data

Aug. 30, 2018 (EP) ..... 18191675

(51) Int. Cl.
*D06F 39/02* (2006.01)

(52) U.S. Cl.
CPC ..... *D06F 39/02* (2013.01)

(58) Field of Classification Search
None
See application file for complete search history.

(56) References Cited

FOREIGN PATENT DOCUMENTS

| | | |
|---|---|---|
| EP | 2251481 A1 | 11/2010 |
| EP | 2281938 A1 | 2/2011 |
| EP | 3067458 A1 | 9/2016 |

OTHER PUBLICATIONS

International Search Report and Written Opinion for International Application No. PCT/EP/2019/072610, dated Oct. 21, 2019, 9 pages.

*Primary Examiner* — Levon J Shahinian
(74) *Attorney, Agent, or Firm* — Bradley Arant Boult Cummings LLP

(57) ABSTRACT

A laundry appliance having a cabinet and a drawer having at least one compartment for containing laundry treatment agent. The compartment has a top opening and a top cover with first and second coupling members. Each coupling member is switchable between engagement and disengagement with the drawer, and the top cover is firmly coupled to the drawer when both the at least one first coupling member and the at least one second coupling member are in the engaged condition. The first and second coupling members are configured to: prevent the second coupling member from switching to the engaged condition when the first coupling member is in the engaged condition; and allow the second coupling member to switch to the engaged condition when the first coupling member is in the disengaged condition.

20 Claims, 9 Drawing Sheets

LAUNDRY APPLIANCE HAVING A DRAWER PROVIDED WITH IMPROVED TOP COVER

This application is a U.S. National Phase application of PCT International Application No. PCT/EP2019/072610, filed Aug. 23, 2019, which claims the benefit of European Application No. 18191675.0, filed Aug. 30, 2018, both of which are incorporated by reference herein.

FIELD OF THE INVENTION

The present invention relates to the field of laundry treatment appliances (hereinafter, concisely, "laundry appliances"), and particularly to laundry appliances for treating, e.g. washing, items (such as linen, clothes, garments, shoes, and the like), such as laundry washing machines and laundry washing machines also implementing laundry drying functions (also referred to as washers/dryers).

BACKGROUND OF THE INVENTION

In order to perform washing cycles (e.g., comprising washing, rinsing and draining phases) on laundry located in the laundry treatment chamber of a laundry appliance, water and laundry treatment agents (such as liquid and powder treatment agents) should be fed into the laundry treatment chamber in a controlled way during the various phases of the washing cycles.

For this reason, a laundry appliance typically comprises a drawer having drawer compartments for containing one or more of said laundry treatment agents. The laundry is configured to deliver selected amounts of such laundry treatment agents contained in the drawer compartments into the laundry treatment chamber, mixed with proper amounts of water.

In addition to, or in the place of drawer compartments adapted to contain a single dose of a respective laundry treatment agent for performing a single washing cycle (hereinafter referred to as single-dose compartments), in an increasingly common type of laundry appliance, the drawer comprises one or more compartments each one adapted to contain multiple doses of a respective treatment agent for performing multiple washing cycles (hereinafter referred to as multi-dose compartments). Just as an example, in case of two multi-dose compartments, a multi-dose compartment may be arranged to contain multiple doses of a liquid washing detergent, whereas the other multi-dose compartment may be arranged to contain multiple doses of a liquid softener. In this class of laundry appliance, the laundry appliance may implement an auto-dosing functionality in which, at each washing cycle (and when the auto-dosing functionality is enabled), a predetermined amount of treatment agent is automatically taken (e.g., by means of a pumping apparatus) from the multi-dose compartment(s) and dispensed to the laundry treatment chamber through proper channels together with water supplied by a water distribution system of the laundry appliance.

It is known to equip drawers for laundry appliances with drawer top covers (hereinafter, simply "top covers") adapted to cover at least partially the compartments for the laundry treatment agents. Preferably, the top cover is arranged to cover at least partially the multi-dose compartments, however, the top cover may be also arranged to cover at least partially the single-dose compartments.

The top cover is advantageously provided for protecting the laundry treatment agent stored in the compartments from dirt or foreign objects coming from outside, as well as for avoiding (or at least reducing) evaporation of the stored laundry treatment agent. Moreover, the top cover may advantageously allow to avoid undesired laundry treatment agent spilling.

If the drawer is not accurately cleaned from time to time, laundry washing agent residuals and/or stagnant water may cause washing agent delivery devices to clog and/or bad smelling to generate. For this purpose, the top cover is usually coupled to the drawer in a releasable way, so that it can be disengaged entirely from the drawer for uncovering the laundry treatment agent compartments and easing the cleaning operations thereof.

In order to allow a releasable coupling between the drawer and the top cover, it is known to provide a releasable coupling system which can be manually operated by the user.

For example, known coupling systems comprise a plurality of snap-fit elements located at borders of the top cover and adapted to engage the drawer in a releasable way, or a plurality of pins or screws adapted to be releasably fitted into corresponding seats located at the drawer by passing through holes located at borders of the top cover.

SUMMARY OF INVENTION

Applicant has realized that the known releasable coupling systems for the releasable coupling between the drawer and the top cover are not efficient, because they are affected by drawbacks.

Indeed, the known solutions force a user who is trying to detach the top cover from the drawer to perform a series of inconvenient operations which require a not negligible amount of time.

Making reference to the known coupling systems comprising a plurality of snap-fit elements located at borders of the top cover, the user is compelled to interact with all the snap-fit elements because in order to free the top cover, all the snap-fit elements should be disengaged: this operation is quite long and uncomfortable, because the snap-fit nature of this elements usually requires to disengage all the elements at the same time. This operation is particularly cumbersome since the snap-fit elements are usually small and provided with very small grip portions, generally too small for allowing a user to easily and comfortably interact with more than one of them at the same time. Moreover, the difficulty of this operation usually causes the user to succeed in actually opening all the snap-fit elements only after having performed a series of different attempts. This may cause in turn the snap-fit elements to wear down, and, in the worst cases, to break.

Even in the case of the known coupling systems comprising pins or screws, the operations required to disengage the top cover from the drawer are cumbersome and require a not negligible amount of time. The user is indeed forced to pull out the pins or screws from the corresponding seats, which is a long process requiring additional tools (such as a screwdriver). Moreover, coupling systems of this kind are not capable of providing a sealing effect (between the top cover and the drawer) sufficient to avoid undesired spilling of laundry treatment agent.

In view of the above, in order to avoid the abovementioned drawbacks, Applicant has devised a system for coupling the top cover to the drawer in a releasable way which is efficient, handy and durable, and which at the same time does not require long and cumbersome operations to be carried out by the user when trying to detach the top cover from the drawer.

Applicant has found that by providing a coupling system comprising two different (from the mechanical and functional point of view) kinds of coupling members, for which a first kind is allowed to switch from a disengaged condition to an engaged condition when the second kind is still in the disengaged condition, and the first kind is prevented to switch from the disengaged condition to the engaged condition when the second kind is already in the engaged condition, the drawbacks affecting the known solutions could be efficiently overcome.

One or more aspects of the present invention are set out in the independent claims, with advantageous features of the same invention that are indicated in the dependent claims.

An aspect of the present invention relates to a laundry appliance.

According to an embodiment of the present invention, the laundry appliance comprises a cabinet accommodating a laundry treatment chamber and a drawer configured to slide with respect to the cabinet along a sliding direction.

According to an embodiment of the present invention, the drawer comprises at least one compartment for containing laundry treatment agent to be selectively provided to the laundry treatment chamber.

According to an embodiment of the present invention, said at least one compartment is provided with a top opening for the loading of the laundry treatment agent from above.

According to an embodiment of the present invention, the drawer further comprises a top cover adapted to cover at least partially the top opening of the at least one compartment.

According to an embodiment of the present invention, the top cover comprises at least one first coupling member and at least one second coupling member.

According to an embodiment of the present invention, each one of said at least one first coupling member and at least one second coupling member is adapted to be switched between an engaged condition in which it engages the drawer and a disengaged condition in which it is disengaged from the drawer, so that the top cover is firmly coupled to the drawer when both the at least one first coupling member and the at least one second coupling member are in the engaged condition.

According to an embodiment of the present invention, the first and second coupling members are configured to:

- prevent the second coupling member to switch from the disengaged condition to the engaged condition when the first coupling member is in the engaged condition;
- allow the second coupling member to switch from the disengaged condition to the engaged condition when the first coupling member is in the disengaged condition.

According to an embodiment of the present invention, the at least one second coupling member is configured such that, when the at least one first coupling member is in the disengaged condition, and at the same time the at least one second coupling member is in the engaged condition, the top cover is allowed to be moved with respect to the drawer with the at least one second coupling member acting as a fulcrum.

According to an embodiment of the present invention, said at least one first coupling member comprises a respective snap-fitting portion adapted to engage a respective drawer portion in the engaged condition.

According to an embodiment of the present invention, said at least one first coupling member comprises a release portion operable by a user to switch the at least one first coupling member the disengaged condition by releasing the snap-fitting portion from the corresponding drawer portion.

According to an embodiment of the present invention, said at least one second coupling member comprises a respective cantilevered element.

According to an embodiment of the present invention, the drawer further comprises at least one slit adapted to receive the cantilevered element of a respective second coupling member when said second coupling member is in the engaged condition.

According to an embodiment of the present invention, the drawer further comprises at least one cantilevered element.

According to an embodiment of the present invention, at least one second coupling member comprises a respective slit adapted to receive a respective cantilevered element when the second coupling member is in the engaged condition.

According to an embodiment of the present invention, said slit is shaped in such a way that, when the at least one first coupling member is in the disengaged condition and at the same time the at least one second coupling member is in the engaged condition, a slit/cantilevered element mechanical play is left to allow a rotation of the top cover with respect to the drawer.

According to an embodiment of the present invention, the at least one first coupling member and the at least one second coupling member are located on opposite ends of the top cover.

According to an embodiment of the present invention, the drawer comprises a drawer rear portion and an opposite drawer front portion.

According to an embodiment of the present invention, the drawer is configured to slide with respect to the cabinet along the sliding direction between:

- a retracted position, in which the drawer is retracted inside cabinet and
- an extracted position, in which the drawer is at least partially extracted from the cabinet and the drawer front portion externally protrudes from the cabinet front.

According to an embodiment of the present invention, a selected one between the at least one first coupling member and the at least one second coupling member is located at a rear end of the top cover located at the rear portion of the drawer when the top cover is coupled to the drawer.

According to an embodiment of the present invention, when the drawer is in the retracted position, the drawer front portion is substantially flush with a cabinet front.

According to an embodiment of the present invention, the at least one first coupling member is located at said rear end of the top cover.

According to an embodiment of the present invention, the at least one second coupling member is located at a front end of the top cover opposite to the rear end.

According to an embodiment of the present invention, the drawer comprises, from the drawer front portion and along the sliding direction:

- a handle forming the drawer front;
- behind the handle, at least one compartment adapted to contain multiple doses of the laundry treatment agent;
- behind the at least one compartment, at least one channel associated with the at least one compartment for channelling water and at least one dose of the laundry treatment agent towards a mixing region allowing a mixture between the water and the at least one laundry treatment agent dose;
- behind the at least one channel, at least one pump actuation part having a suction side in fluid communication with the at least one compartment for drawing up the at least one laundry treatment agent dose therefrom, and a delivery side in fluid communication with the at least one channel for delivering the at least one treatment agent dose thereto.

According to an embodiment of the present invention, said at least one first coupling member is arranged to engage a portion of a wall between the at least one compartment and the at least one channel when said at least one first coupling member is in the engaged condition.

According to an embodiment of the present invention, the drawer comprises between the handle and the at least one compartment adapted to contain multiple doses of the laundry treatment agent, at least one further compartment adapted to contain a single dose of the laundry treatment agent.

According to an embodiment of the present invention, the top cover comprises one or more access apertures, in fluid communication with a respective one of the at least one compartment for allowing the laundry treatment agent to be loaded therein when the top cover is coupled to the drawer.

According to an embodiment of the present invention, the top cover further comprises at least one wall member surrounding from below a respective one access apertures and downwardly extending from the top cover into the respective compartment when the top cover is coupled to the drawer.

According to an embodiment of the present invention, borders of said at least one compartment comprise seats adapted to receive borders of the top cover when the top cover is coupled to the drawer.

According to an embodiment of the present invention, the top cover comprises at least one breaking wall member comprising a wall which downwardly extends from the top cover into one of the at least one compartment when the top cover is coupled to the drawer for breaking waves forming in the laundry treatment agent contained in said at least one compartment when the drawer is moved along the sliding direction.

Another aspect of the present invention relates to a method.

According to an embodiment of the present invention, the method comprises providing a drawer configured to slide with respect to a cabinet of a laundry appliance, the drawer comprising at least one compartment for containing laundry treatment agent to be selectively provided to a laundry treatment chamber of the laundry appliance, said at least one compartment being provided with a top opening for the loading of the laundry treatment chamber from above.

According to an embodiment of the present invention, the method comprises providing a top cover adapted to cover at least partially the top opening of the at least one compartment, the top cover comprising at least one first coupling member and at least one second coupling member each one of said at least one first coupling member and at least one second coupling member being adapted to be switched between an engaged condition in which it engages the drawer and a disengaged condition in which is disengaged from the drawer, so that the top cover is coupled to the drawer when both the at least one first coupling member and the at least one second coupling member are in the engaged condition.

According to an embodiment of the present invention, the first and second coupling members are configured to:

a) prevent the second coupling member to switch from the disengaged condition to the engaged condition when the first coupling member is in the engaged condition;

b) allow the second coupling member to switch from the disengaged condition to the engaged condition when the first coupling member is in the disengaged condition.

According to an embodiment of the present invention, the method comprises having the at least one second coupling member be in the engaged condition and the at least one first coupling member be in the disengaged condition; then, having the top cover be moved with respect to the drawer around the at least one second coupling member until the top cover covers at least partially the top opening of the at least one compartment, and then having the at least one first coupling member be switched in the engaged condition.

According to an embodiment of the present invention, the method further comprises:

having the at least one first coupling member be in the engaged condition and the at least one second coupling member be in the engaged condition; then having the at least one first coupling member be switched in the disengaged condition; then having the top cover be moved with respect to the drawer around the at least one second coupling member to uncover the top opening of the at least one compartment, and then having the at least one second coupling member be switched in the disengaged condition.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS OF THE INVENTION

Figure 1A:
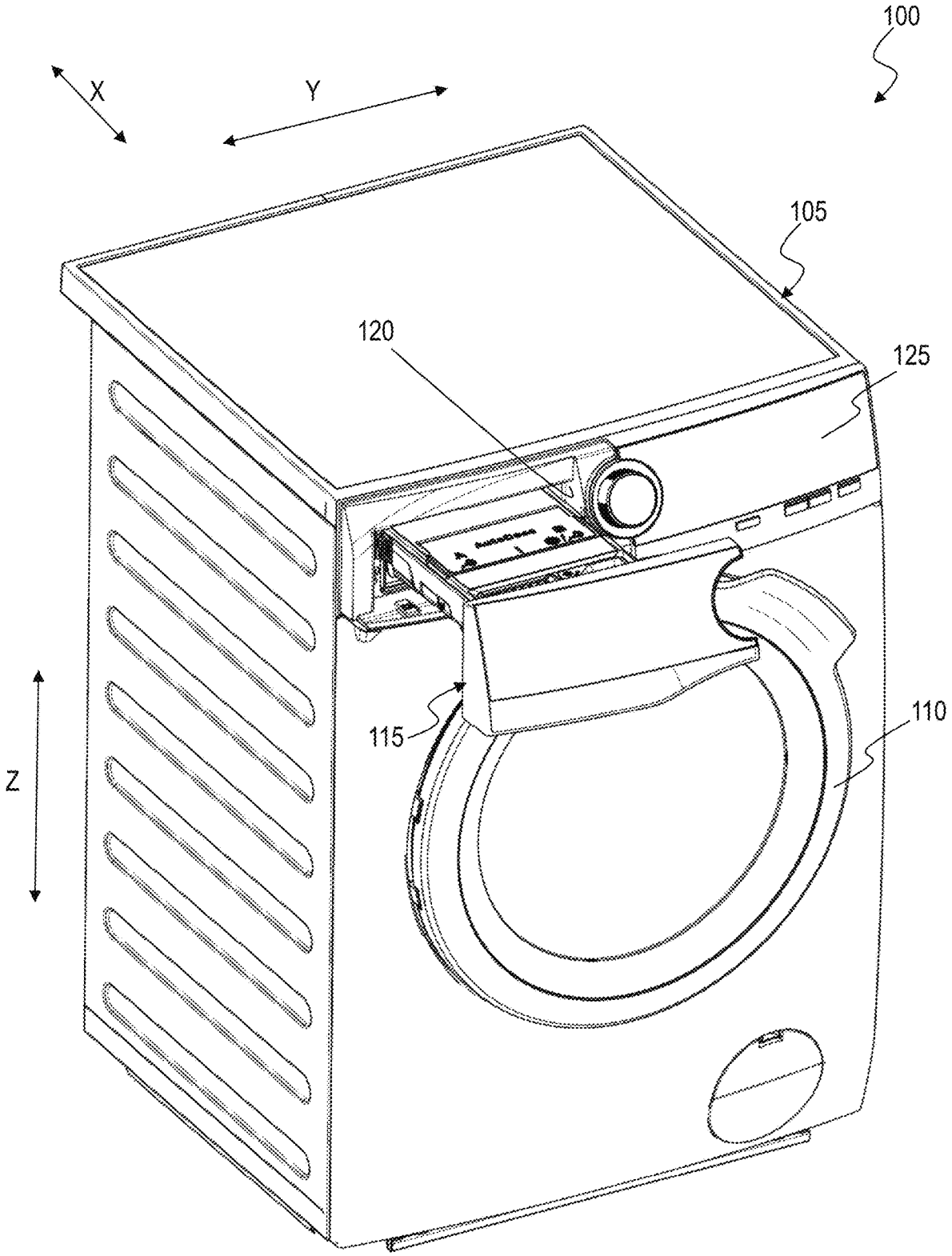
FIGS. 1A and 1B show perspective views of a laundry appliance according to an embodiment of the present invention.
Figure 1B:
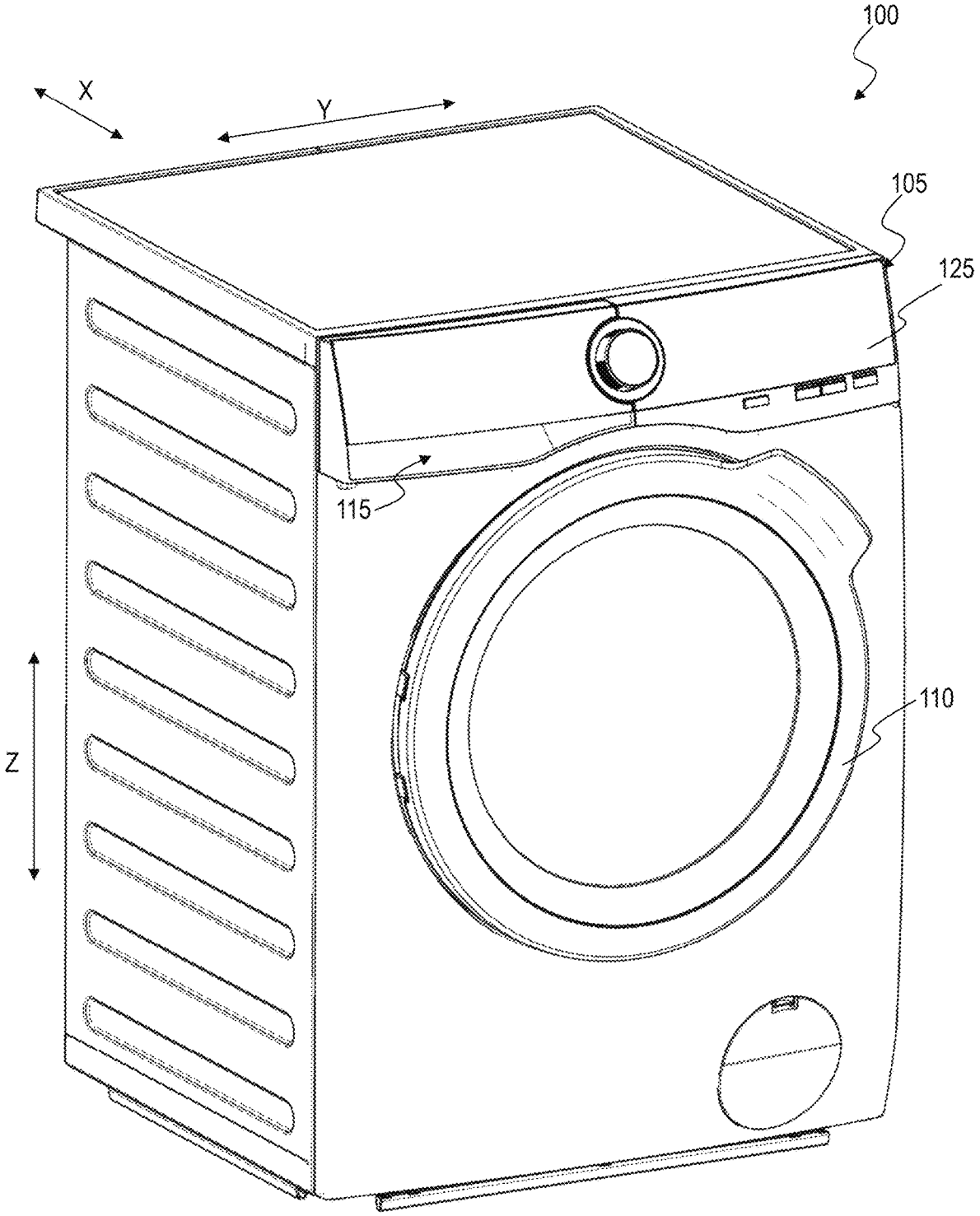

With reference to the drawings, sharing the same reference system identified by the three orthogonal directions x, y and z, FIGS. 1A and 1B show perspective views of a laundry appliance 100 according to an embodiment of the present invention. According to the exemplary, not limiting, embodiment herein considered, the laundry appliance 100 is a washing machine. In any case, although in the following description explicit reference will be made to a washing machine, this should not to be construed as a limitation; indeed, the present invention applies to other types of laundry appliances (for example combined washers/dryers, i.e. washing machines also having laundry drying functions). In operation, the laundry appliance 100 rests on a rest surface, such as the floor, parallel to directions x and y, and uprightly extends from it along direction z.

The laundry appliance 100 comprises a (e.g., parallepiped-shaped) cabinet 105, which preferably accommodates a laundry treatment chamber (i.e., a laundry washing chamber in the example herein considered of a washing machine) for performing a laundry treatment cycle on items housed therein (i.e., a washing cycle on a laundry load in the example herein considered of a washing machine).

The laundry treatment chamber (also simply referred to as treatment chamber) preferably comprises a washing tub (not shown) and, within it, a (e.g., rotatable) washing basket or drum (not shown) adapted to contain the laundry load to be washed. A cabinet front has a loading opening providing an access to the drum for loading/unloading the laundry load, a door 110 (shown in a closed position in FIGS. 1A and 1B) being provided for sealably closing the loading opening during the operation of the laundry appliance 100.

Although not shown, the laundry appliance 100 also comprises, enclosed in the cabinet 105, electrical/electronic/mechanical/hydraulic components for the operation of the laundry appliance 100 (such as for example motor, electromechanical valves, pumps and impellers of the hydraulic apparatus, one or more heating elements for heating water/treatment agents/air).

The laundry appliance 100 is advantageously equipped with a laundry appliance control system (not visible in FIGS. 1A and 1B) comprising control units, power supply modules, driving units, power regulators and generally all the electric and electronic components which are responsible for the driving, control, and supply of the electrical/electronic/mechanical/hydraulic components of the laundry appliance 100. Preferably, at least part of said laundry appliance control system is located on one or more dedicated electronic boards, for example located on the top part of the cabinet.

The laundry appliance 100 further comprises a storage drawer 115 (briefly, or, concisely, drawer) for containing one or more laundry treatment agents (or, concisely, treatment agents), such as liquid and powder treatment agents including, but not limited to, washing detergents, rinsing detergents, bleaches and softeners. The cabinet 105 comprises a drawer seat 120 (preferably provided on a top part of a cabinet front) for housing the drawer 115, the drawer being advantageously adapted to slide within the drawer seat 120, along a longitudinal or sliding direction, between an extracted position (shown in FIG. 1A) and a retracted position (shown in FIG. 1B). The sliding direction is for example parallel to direction x, or may be slightly slanted with respect thereto.

As already mentioned in the introduction, by retracted position of the drawer 115 it is intended a position in which the drawer 115 is (fully) retracted inside the drawer seat 120 (as in the situation illustrated in FIG. 1B), while by extracted position of the drawer 115, it is intended a position in which the drawer 115 is at least partially extracted from the drawer seat 120 and preferably, but not necessarily, protrudes from the cabinet 105 (as in the situation illustrated in FIG. 1A).

Preferably, the laundry appliance 100 further comprises a user interface 125, the user interface 125 being preferably provided on the top part of the cabinet front, more preferably next to the drawer seat 120 along direction y.

Preferably, although not necessarily, the user interface 125 comprises a display unit, not shown, for visually displaying one or more pieces of information; the display unit may for example be a light emitting polymer display (LPD), a liquid crystal display, a thin film transistor-liquid crystal display, or an organic light-emitting diode display.

The user interface 125 preferably comprises one or more control elements (e.g., selection buttons and/or knobs) for allowing the user to select a washing cycle and to control one or more operating parameters of the selected washing cycle (including, but not limited to, temperature, laundry load dirt level, spin speed, start time delay, drawer compartment selection, treatment agent selection).

Additionally, as herein exemplary assumed, or alternatively, the user interface 125 preferably comprises one or more status indicators for indicating to the user a status of the laundry appliance 100; the status indicators may be configured to indicate a status of one or more components of the laundry appliances 100 and/or a status of the washing cycle (including, but not limited to, information about a residual time to the end of the ongoing washing cycle, and/or information about a current phase of the ongoing washing cycle, and/or selected parameters for the ongoing washing cycle, and/or selected drawer compartment, and/or selected treatment agent).

Figure 2A:
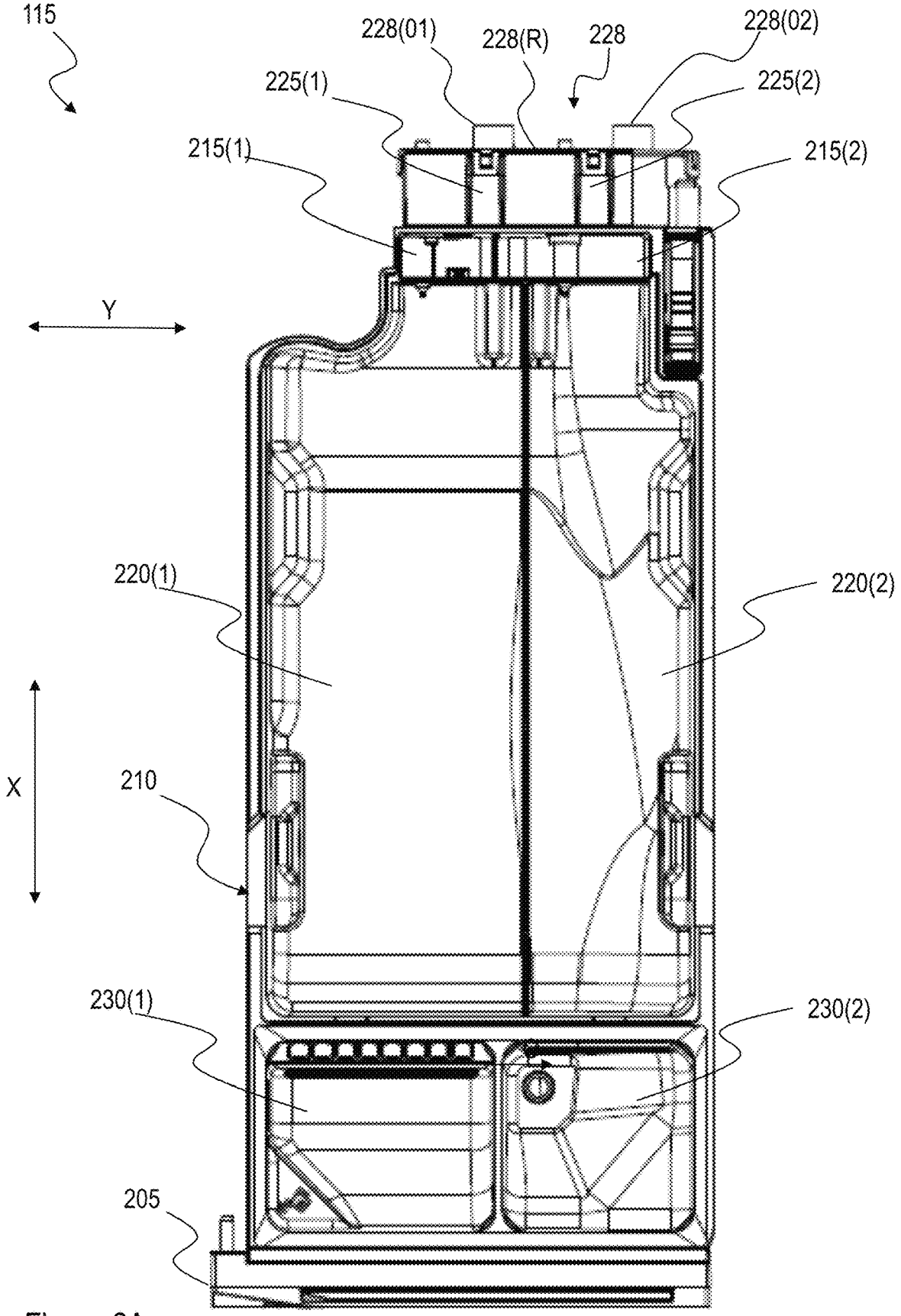
FIG. 2A shows a top view of a drawer of the laundry appliance according to an embodiment of the present invention.
Figure 2B:
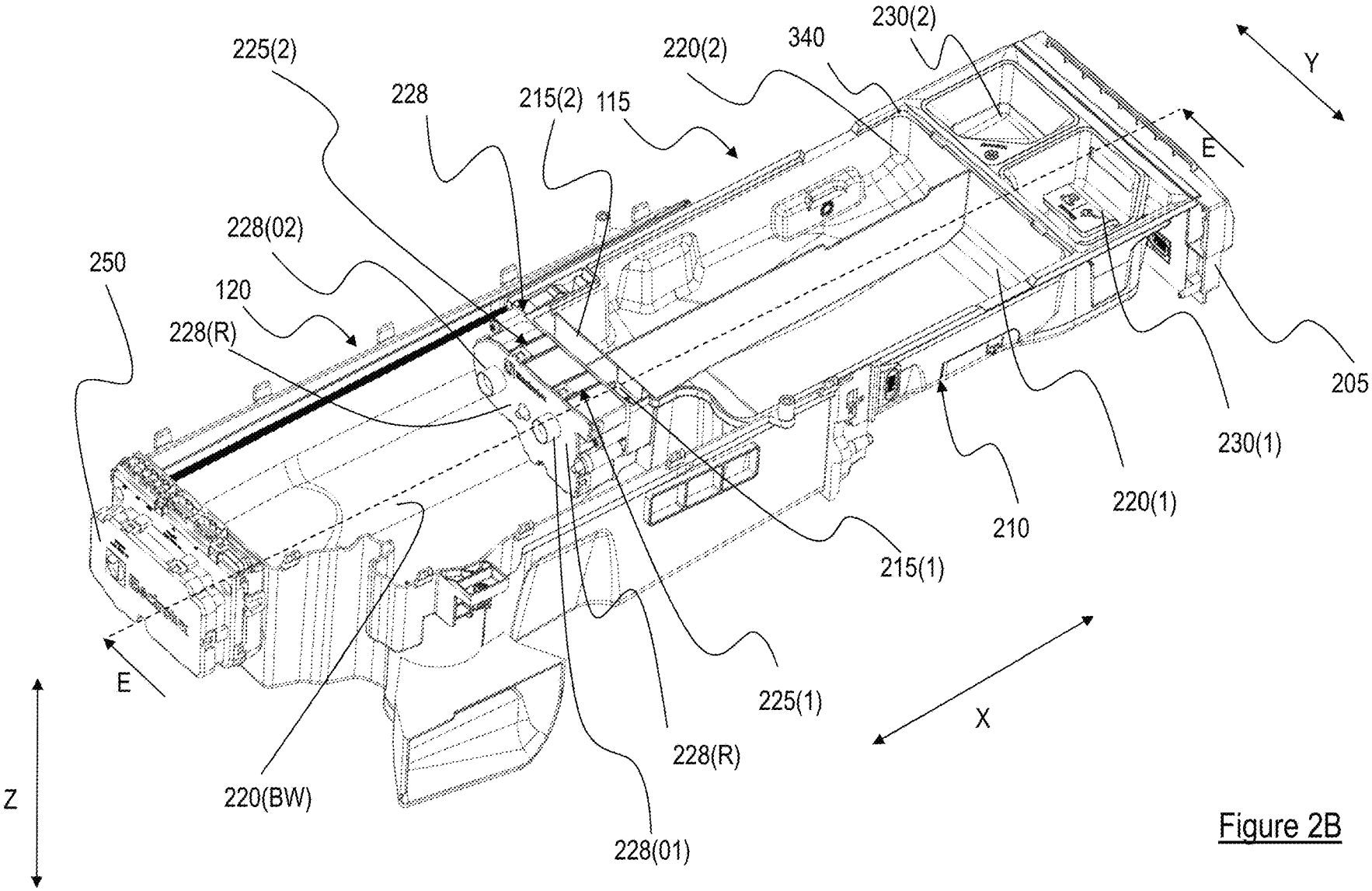
FIG. 2B shows a perspective view of the drawer of FIG. 2A in an extracted position within a drawer seat, according to an embodiment of the present invention.

With reference now also to FIG. 2A, it shows a top view of the drawer 115 according to an embodiment of the present invention. For ease of description, FIG. 2A will be discussed together with FIG. 2B, which shows a perspective view of the drawer 115 in the extracted position, wherein the drawer 115 is partially extracted from the drawer seat 120, with FIG. 2C, which shows a perspective and partially exploded view from behind of the drawer 115 and of the drawer seat 120, and with FIGS. 2D, 2E, which show section views of the drawer 115 housed in the drawer seat 120 along a plane parallel to directions x and z and passing through section line E-E depicted in FIG. 2B (wherein FIG. 2D shows the drawer 115 in the retracted position, while FIG. 2E shows the drawer in the extracted position).

The drawer 115 preferably comprises a drawer handle 205 allowing the user to slidably move the drawer 115 between the extracted position and the retracted position when it is fitted in the drawer seat 120, and a drawer body 210 to which the drawer handle 205 is adapted to be mounted or coupled or connected (for example, in a removable or reversible way). When the laundry appliance 100 is installed and the drawer 115 is fitted in the drawer seat 120, the drawer handle 205 preferably identifies, along direction x, a drawer front (which advantageously forms part of the cabinet front when the drawer 115 is in the retracted position).

The drawer 115 preferably comprises, along direction x (from the drawer front backwards):

behind the handle 205, and hence in the drawer body 210, one or more (two, in the example at issue) drawer compartments 220(1), 220(2) each one adapted to contain multiple doses of a respective laundry treatment agent for performing multiple washing cycles, hereinafter referred to as multi-dose compartments 220(1), 220(2); each multi-dose compartment 220(1), 220(2) is provided with a top opening for the loading of laundry treatment agent from above. Therefore, the exemplary considered laundry appliance 100 is configured to implement an auto-dosing functionality in which, at each washing cycle (and when the auto-dosing functionality is enabled), a predetermined amount of treatment agent is automatically taken (e.g. by means of a pumping system, discussed in the following) from one or both of the multi-dose compartments 220(1), 220(2). Just as an example, the multi-dose compartment 220(1) may be arranged to contain multiple doses of a liquid washing detergent, whereas the multi-dose compartment 220(2) may be arranged to contain multiple doses of a liquid softener;

behind the multi-dose compartments 220(1), 220(2), and hence in the drawer body 210, one or more (two, in the example at issue) channels 215(1), 215(2) associated with the multi-dose compartments 220(1), 220(2) (in the example herein considered, each channel 215(1), 215(2) is associated with a respective one of the multi-dose compartments 220(1), 220(2), the channel 215(1) being for example associated with the multi-dose compartment 220(1) and the channel 215(2) being for example associated with the multi-dose compartment 220(2)). Each channel 215(1), 215(2) is preferably adapted to channel water and/or one or more treatment agent doses towards a region of the drawer seat 120 that allows a mixture between the water and the treatment agent dose(s) (hereinafter referred to as mixing region): the mixing region may for example be or comprise a bottom wall 220(BW) of the drawer seat 120 (visible in FIG. 2B), the bottom wall 220(BW) of the drawer seat 120 being advantageously slanted in order to promote a flow of the mixture between the water and the treatment agent dose(s) towards the treatment chamber of the laundry appliance 100. Advantageously, the channels 215(1), 215(2) (or at least one thereof) extend vertically with respect to the rest surface (such as the floor) on which the laundry appliance 100 rests in operation (the channels 215(1), 215(2) thus extending substantially along direction z). In alternative embodiments of the present invention, the channels 215(1), 215(2) (or at least one thereof) are inclined with respect to the rest surface (such as the floor) on which the laundry appliance 100 rests in operation. Regardless of the specific (vertical or inclined) orientation of the channels 215(1), 215(2), which is not limiting for the present invention, each channel 215(1), 215(2) is structured and shaped such as to allow the water and/or the treatment agent dose(s) to fall towards the mixing region of the drawer seat 120 by gravity; in order to achieve it, each channel 215(1), 215(2) advantageously comprises a top channel input for receiving the water from a water distribution system above it (not illustrated) and a bottom channel output facing the bottom wall 220(BW) of the drawer seat 120; in operation the bottom channel outputs of the channels 215(1), 215(2) are arranged for delivering the water and the treatment agent dose(s) to the bottom wall 220(BW) of the drawer seat 120, and hence to the treatment chamber of the laundry appliance 100. Having two separate channels 215(1), 215(2) each one associated with a respective multi-dose compartment 220(1), 220(2) is particularly advantageous in the preferred embodiment herein considered in which the multi-dose compartments 220(1), 220(2) store different types of treatment agents (e.g., liquid washing detergent and liquid softener); in fact, in this way, a mixing between the two different types of treatment agents due to the presence of treatment agent residues from channel walls is avoided;

behind the channels 215(1), 215(2), and hence in the drawer body 210, one or more (two, in the example at issue) pump actuation parts 225(1), 225(2) of the pumping system. The pump actuation parts 225(1), 225(2) preferably have suction sides in fluid communication with the multi-dose compartments 220(1), 220(2) for drawing up the treatment agent dose(s) therefrom, and delivery sides in fluid communication with the channels 215(1), 215(2) for delivering the treatment agent dose(s) thereto. Preferably, as herein assumed, the pump actuation part 225(1) is associated with the multi-dose compartment 220(1) and with the channel 215(1) (it meaning that the suction and delivery sides of the pump actuation part 225(1) are in fluid communication with the multi-dose compartment 220(1) and with the channel 215(1), respectively), and the pump actuation part 225(2) is associated with the multi-dose compartment 220(2) and with the channel 215(2) (it meaning that the suction and delivery sides of the pump actuation part 225(2) are in fluid communication with the multi-dose compartment 220(2) and with the channel 215(2), respectively). According to an exemplary embodiment of the present invention, the suction sides and the delivery sides of the pump actuation part 225(1), 225(2) comprise suction and delivery pipes in the form of deformable tubes, and each pump actuation part 225(1), 225(2) preferably comprises a peristaltic rotor adapted to hydraulically cooperate with the respective deformable tubes for allowing the fluid (i.e., the laundry treatment agent dose(s)) in the deformable tubes to move during the rotation of the peristaltic rotor.

As visible in the figures, the pump actuation parts 225(1), 225(2) are advantageously housed in a corresponding pump housing 228 on the rear portion of the drawer 115 (rear with respect to the drawer front along direction x).

When the drawer 115 is in the retracted position, the pump actuation parts 225(1), 225(2) are adapted to mechanically couple with one or more electrically-operated pump driving parts (preferably provided in the drawer seat 120) of the pumping system, upon said mechanical coupling the electrically-operated pump driving parts allowing driving of the pump actuation parts 225(1), 225(2), such as rotating the peristaltic rotor thereof.

According to the preferred embodiment of the present invention herein considered and illustrated, the drawer 115 also comprises one or more (two, in the example at issue) drawer compartments 230(1), 230(2) each one adapted to contain a single dose of a respective treatment agent for performing a single washing cycle, hereinafter referred to as mono-dose compartments 230(1), 230(2); just as an example, the mono-dose compartment 230(1) may be arranged to contain a single dose of a powder or liquid washing detergent, whereas the mono-dose compartment 230(2) may be arranged to contain a single dose of a powder or liquid or pearl softener. Each mono-dose compartment 230(1), 230(2) is provided with a top opening for the loading of laundry treatment agent from above.

Preferably, the mono-dose compartments 230(1), 230(2) are, along direction x, between the handle 205 and the multi-dose compartments 220(1), 220(2). More preferably, the mono-dose compartments 230(1), 230(2) are formed in a region of the drawer body 210 that, when the drawer handle 205 is mounted on the drawer body 210, is proximal to the drawer handle 205 (hereinafter referred to as front region of the drawer body 210), whereas the multi-dose compartments 220(1), 220(2) are formed in a region of the drawer body 210 (hereinafter referred to as rear region of the drawer body 210) that, along direction x, is rearward with respect to the front region of the drawer body 210.

The already mentioned water distribution system may advantageously comprise a water duct system forming a top 255 of the drawer seat 120 (see FIG. 2C), thus allowing the water to be fed to the channels 215(1), 215(2) (and/or to the mono-dose compartments 230(1), 230(2), when provided) from above. For example, such water duct system may be provided with water output ends (not visible in figures) which are arranged to be located above the channels 215(1), 215(2) (and also above the mono-dose compartments 230(1), 230(2), when provided) when the drawer 115 is in the retracted position.

As mentioned above, the pump actuation part 225(1), 225(2) of the pumping system is adapted to mechanically couple, in the retracted position of the drawer 115, with respective one or more electrically-operated pump driving parts (for example, with a respective electrically-operated pump driving part) of the pumping system provided in the drawer seat 120 for allowing driving of the pump actuation part 225(1), 225(2).

Each electrically-operated pump driving part may for example comprise a pump electric motor 245(1), 245(2) (the electric motor 245(1) being visible in FIGS. 2D, 2E) selectively actuatable (e.g., by means of a washing cycle control system and of an electric power supply unit of the laundry appliance control system) for operating the respective pump actuation part 225(1), 225(2) (in alternative embodiments of the present invention, a single electric motor may be provided in order to selectively operate both the pump actuation part 225(1), 225(2)), and an output shaft 245(S1), 245(S2) (the output shaft 245(S1) being visible in FIGS. 2D, 2E) adapted to be fitted into a corresponding seat 225(S1), 225(S2) of the respective pump actuation part 225(1), 225(2). Advantageously, the output shaft 245(S1), 245(S2) and the respective seat 225(S1), 225(S2) of the pump actuation part 225(1), 225(2) have mutually complementary shapes (the output shaft 245(S1), 245(S2) having for example a multi-lobed shape or a star shape), so as to couple or engage with each other when the drawer 115 is moved to the retracted position. More advantageously, each seat 225(S1), 225(S2) is torsionally supported by the pump actuation part 225(1), 225(2), whereby the coupling between each output shaft 245(S1), 245(S2) and the respective seat 225(S1), 225(S2) takes place in a dampened manner and even if their complementary shapes are not perfectly aligned when drawer 115 is pushed to the retracted position. According to an embodiment of the invention, each seat 225(S1), 225(S2) is torsionally supported by the peristaltic rotor included in the respective pump actuation part 225(1), 225(2)). In this way, when an output shaft 245(S1), 245(S2) is engaged with the corresponding seat 225(S1), 225(S2) (i.e., when the drawer 115 is in the retracted position), the corresponding pump electric motor 245(1), 245(2) could transfer rotational movement to the peristaltic rotor.

The pump housing 228 comprises on a rear face 228(R) substantially parallel to directions y and z and which in operation faces the rear portion of the drawer seat 120 (i.e., where the electric motors 245(1), 245(2) are located) openings 228(O1), 228(O2) through which the output shafts 245(S1), 245(S2) of the electric motors 245(1), 245(2) are able to pass for being coupled with the pump actuation parts 225(1), 225(2) (particularly, with the seats 225(S1), 225(S2) thereof).

The electric motors 245(1), 245(2) are advantageously enclosed in a motor shell 250, preferably fixed on the drawer seat 120 (and, hence, separate from drawer body 210) and facing the rear portion of the drawer 115. The motor shell 250 has a front face 250(F) that faces in operation the rear face 228(R) of the pump housing 228. The front face 250(F) of the motor shell 250 is preferably provided with openings 250(O1), 250(O2) through which the output shafts 245(S1), 245(S2) of the electric motors 245(1), 245(2) project: in this way, when the drawer 115 is moved to the retracted position (i.e., towards the motor shell 250), the output shafts 245(S1), 245(S2) of the electric motors 245(1), 245(2) engage the pump actuation parts 225(1), 225(2), thus allowing mechanical coupling therebetween.

Returning back to FIG. 2C, the drawer 115 preferably comprises a drawer body top cover 210(C) (hereinafter, simply referred to as "top cover") for covering the drawer body 210. According to a preferred embodiment of the invention illustrated in the figures, the top cover 210(C) is configured to cover the rear region of the drawer body 110 in such a way to cover the top openings of the multi-dose compartments 220(1), 220(2), but leaves uncovered both the channels 215(1), 215(2), and particularly the top channel inputs thereof (which can therefore be accessed by water fed by the water distribution system) and the front region of the drawer body 210 (and hence the top openings of the mono-dose compartments 230(1), 230(2), which can therefore be directly accessed from above for loading the treatment agents therein). While in the embodiment of the invention illustrated in the figures, the top cover 210(C) is covering entirely the top openings of the multi-dose compartments 220(1), 220(2), similar considerations apply in case the top cover 210(C) is configured to cover only partially the top openings of the multi-dose compartments 220(1), 220(2), and/or to cover at least partially the top openings of the mono-dose compartments 230(1), 230(2).

Even more preferably, the top cover 210(C) comprises one or more access apertures, not shown, each one for accessing a respective multi-dose compartment 220(1), 220(2) for allowing the loading of treatment agent therein; in the example at issue in which the drawer body 210 comprises two multi-dose compartments 220(1), 220(2), two access apertures are provided in the top cover 210(C).

Preferably, one or more access components may be provided for selectively covering and uncovering the access apertures thereby respectively preventing and allowing access to the respective multi-dose compartments 220(1), 220(2) (in the exemplary considered embodiment, no access components are provided for selectively covering and uncovering the mono-dose compartments 230(1), 230(2), however this should not be construed as a limitation). As visible in FIG. 2C, the access components comprises a single door 210(D), for example a flap door pivotally coupled to the top cover 210(C) so as to be actuatable by the user between an open position and a closed position for jointly uncovering and covering, respectively, both the access apertures—in any case, in alternative embodiments of the present invention, not shown, two doors may be provided, each door being for example associated with a respective access aperture, and hence with a respective multi-dose compartment 220(1), 220(2).

Figure 3A:
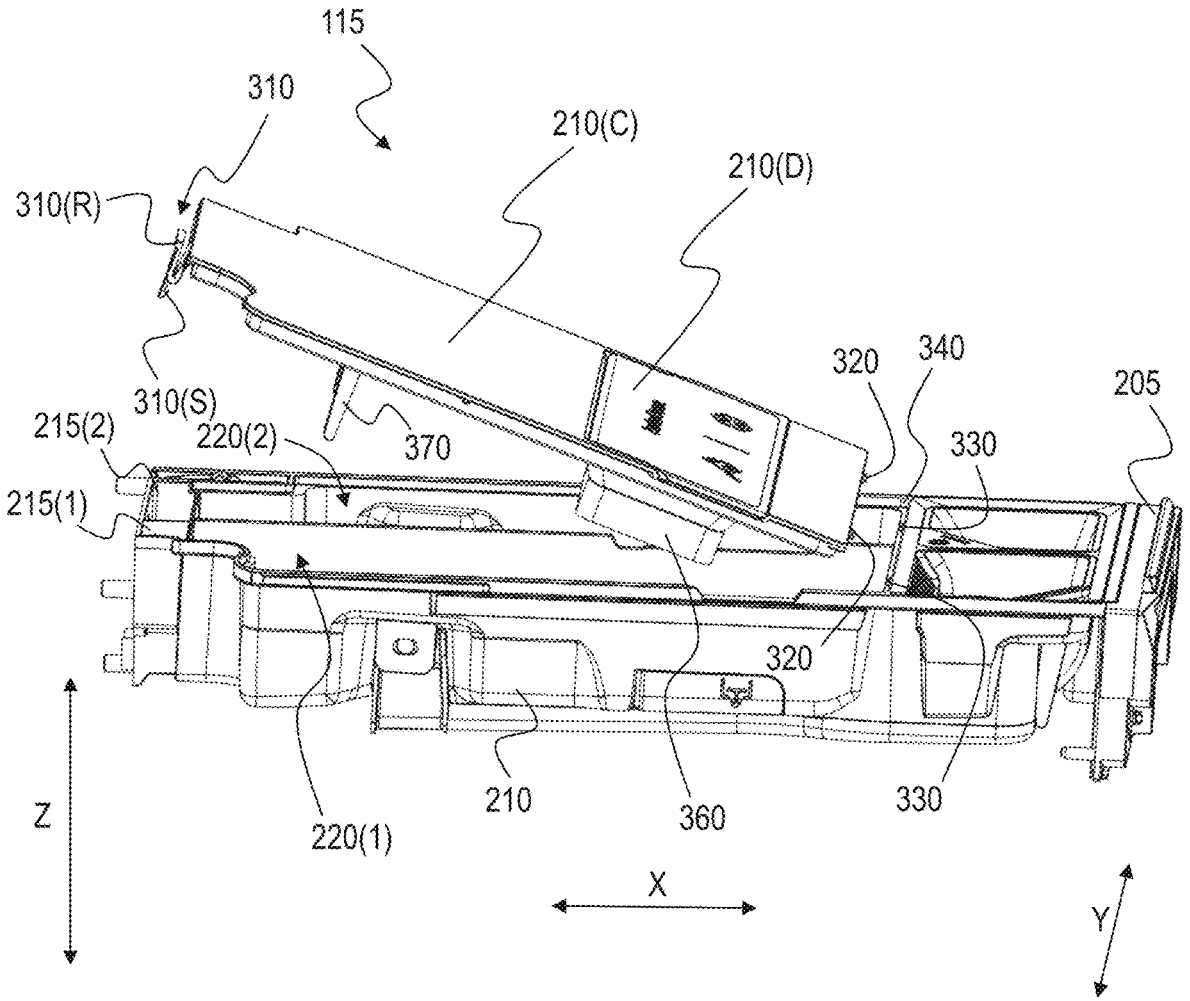
FIG. 3A is a perspective view of the drawer showing a top cover thereof while decoupled from the drawer.
Figure 3B:
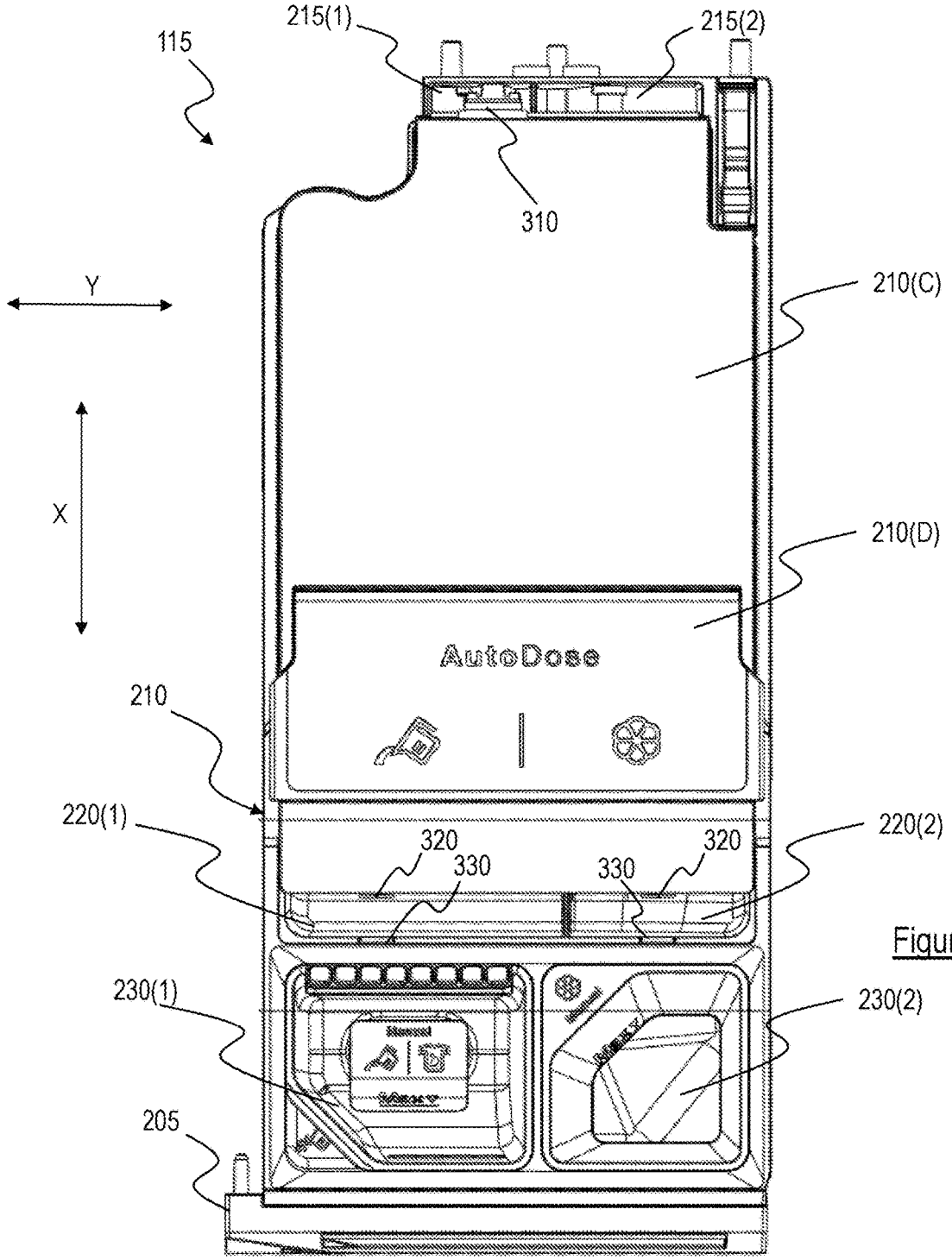
FIG. 3B is a top view of the drawer of FIG. 3A.
Figure 3C:
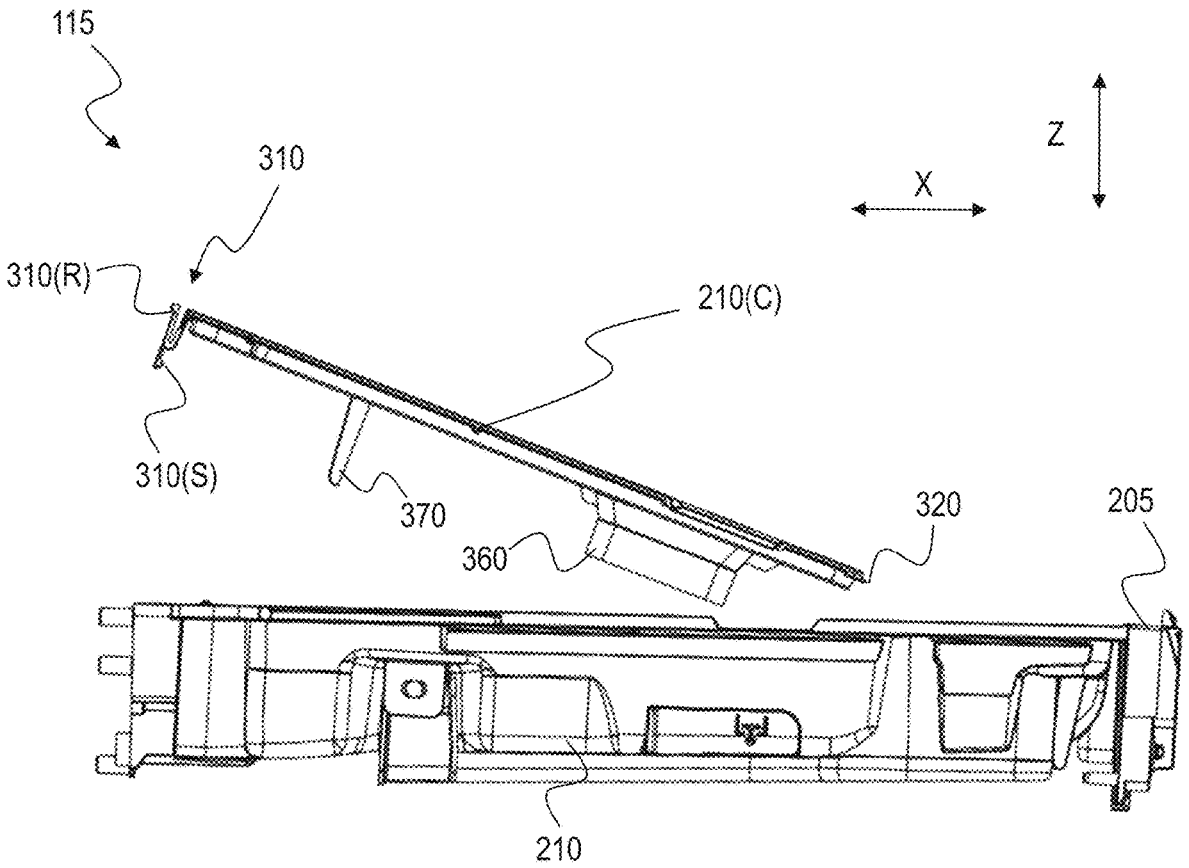
FIG. 3C is a side view of the drawer FIG. 3A.

According to an embodiment of the present invention, the top cover 210(C) is preferably configured to be releasably coupled to the drawer 115 (particularly, to the drawer body 210) by means of a coupling system. In order to describe in detail said coupling system according to an embodiment of the invention, reference will be now made to FIGS. 3A-3D, wherein FIG. 3A is a perspective view of the drawer 115 showing the top cover 210(C) decoupled from the drawer 115, FIG. 3B is a top view of the drawer 115 of FIG. 3A taken from a plane parallel to directions x and y, and FIG. 3C is a side view of the drawer 115 of FIG. 3A taken from a plane parallel to directions x and z.

According to an embodiment of the present invention, the coupling system preferably provides for having coupling members located on the top cover 210(C). Each coupling member is adapted to be switched between an engaged condition in which it engages the drawer 115 (particularly, the drawer body 210) and a disengaged condition in which it is disengaged from the drawer 115.

According to an embodiment of the present invention, the coupling system preferably comprises two different kinds of coupling members, hereinafter referred to as first coupling members (identified in the figures with reference 310) and second coupling members (identified in the figures with reference 320). In the embodiment of the invention illustrated in the figures and which will be described in detail in the following of the description, the coupling system comprises a single first coupling member 310 and two second coupling members 320. However, similar considerations apply in case the coupling system comprises a different number of first coupling members 310 and second coupling members 320 as long as at least one first coupling members 310 and at least one second coupling members 320 are both provided.

According to an embodiment of the present invention, the top cover 210(C) is coupled to the drawer 115 when both the first coupling member(s) 310 and the second coupling member(s) 320 are in the engaged condition.

According to an embodiment of the present invention, the first and second coupling members 310, 320 are configured to:

- prevent the second coupling members 320 to switch from the disengaged condition to the engaged condition when the first coupling members 310 are in the engaged condition;
- allow the second coupling members 320 to switch from the disengaged condition to the engaged condition when the first coupling members 310 are in the disengaged condition.

This peculiar configuration capable of preventing/allowing the second coupling members 320 to switch into the engaged condition according to an embodiment of the present invention is advantageously obtained by exploiting differences in mechanical and functional features between the first coupling member(s) 310 and the second coupling member(s) 320.

More in detail, according to an embodiment of the present invention, each first coupling member 310 comprises a respective snap-fitting portion 310(S) and a respective release portion 310(R) (see FIGS. 3A and 3C). Advantageously, the snap-fitting portion 310(S) is configured to engage a respective portion of the drawer 115 when the first coupling member 310 is in the engaged condition, and the release portion 310(R) is configured to be operable by a user for switching the first coupling member 310 to the disengaged condition by releasing the snap-fitting portion 310(S) from the corresponding drawer portion.

According to the embodiment of the present invention illustrated in the figures, the snap-fitting portion 310(S) preferably is a substantially u-shaped resilient member comprising a protruding tooth adapted to engage a corresponding portion of the wall located between the multi-dose compartments 220(1), 220(2) and the channels 215(1), 215(2).

Figure 2C:
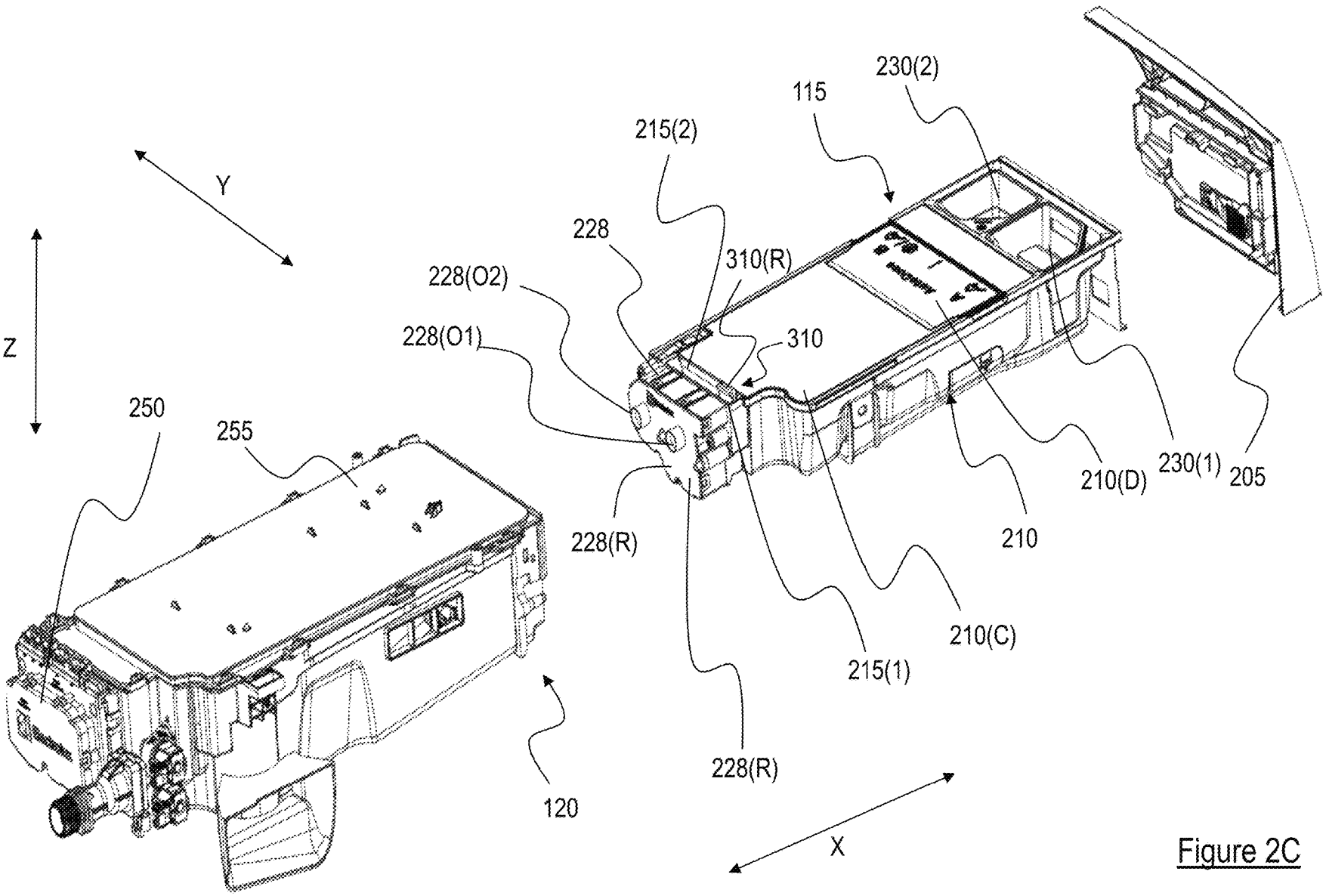
FIG. 2C shows a perspective and partially exploded view from behind of the drawer of FIGS. 2A and 2B and of the drawer seat of FIG. 2B, according to an embodiment of the present invention.
Figure 2D:
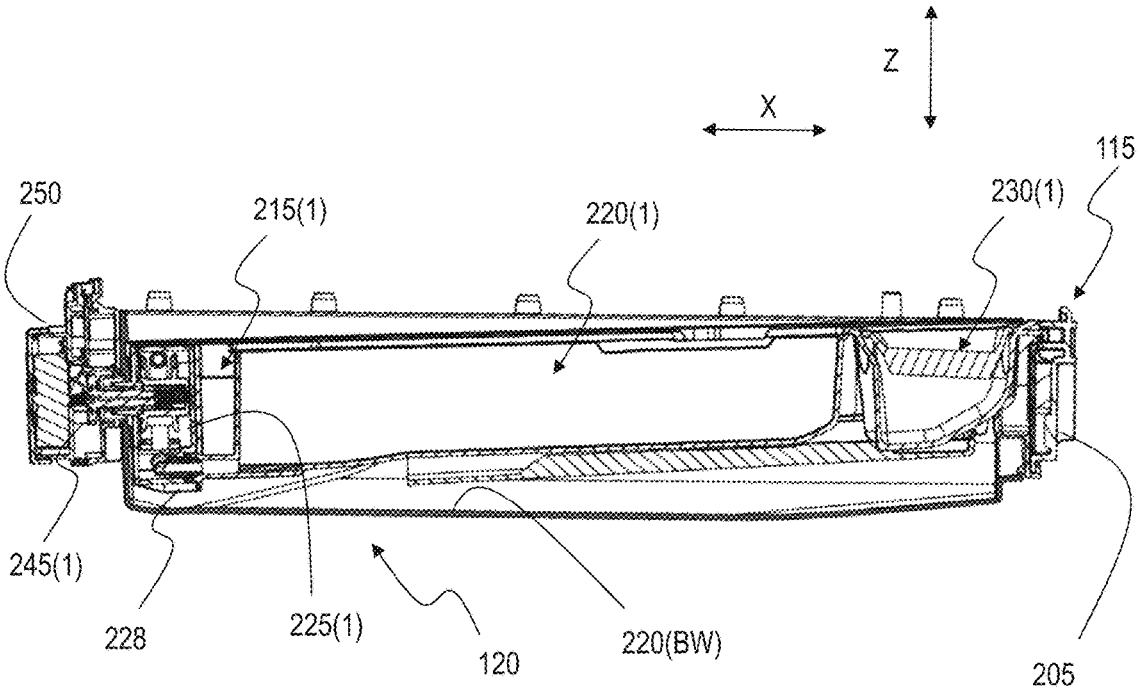
FIG. 2D shows a sectional view of the drawer along the section line E-E line of FIG. 2B when the drawer is in a retracted position.
Figure 2E:
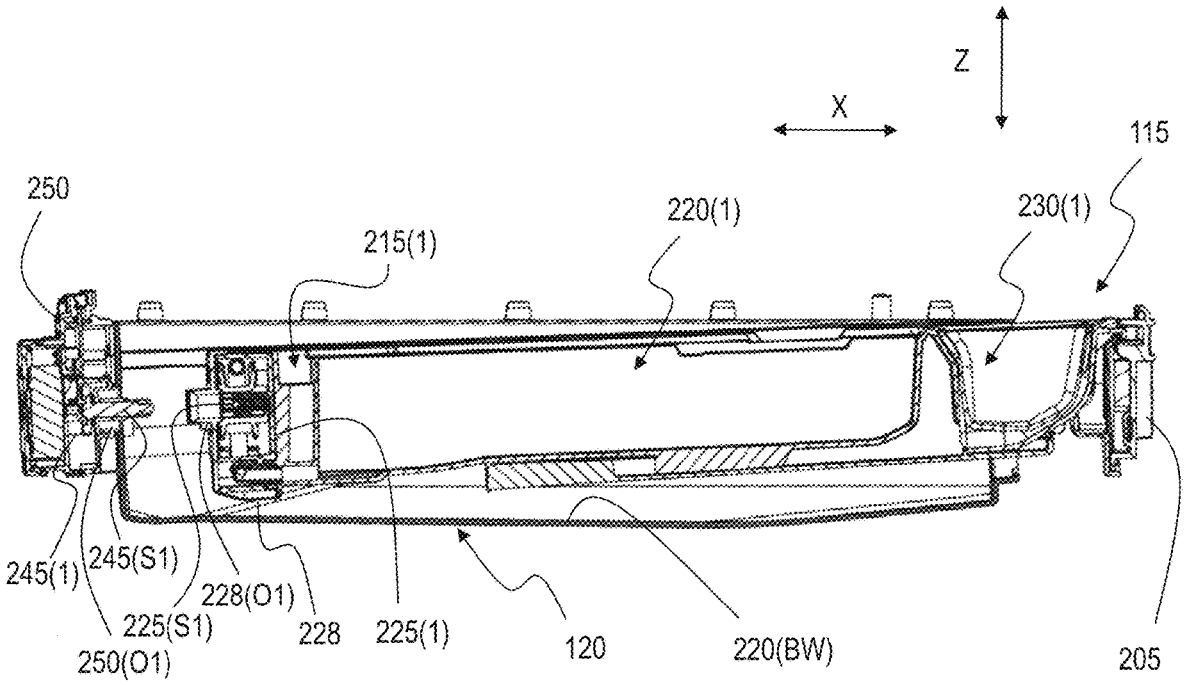
FIG. 2E shows a sectional view of the drawer along the section line E-E line of FIG. 2B when the drawer is in an extracted.

According to an embodiment of the present invention, the release portion 310(R) preferably comprises a grip member preferably configured to protrude upwardly (along direction z) from the top cover 210(C) when the top cover 210(C) is coupled to the drawer 115 (see for example FIG. 2C).

According to an embodiment of the invention of the present invention, each second coupling member 320 preferably comprises a respective cantilevered element configured to be received in a corresponding slit 330 (see for example FIGS. 3A and 3B) located on the drawer 115 when said second coupling member 320 is in the engaged condition. According to an embodiment of the present invention, the slits 330 define corresponding cavities which extend within the drawer substantially along direction x. According to an embodiment of the present invention, the cantilevered elements extend along a direction substantially parallel to the top cover 210(C) surface, so that, when the top cover 210(C) is coupled to the drawer 115, said cantilevered elements extends along direction x inside the slits 330. Therefore, in order to switch the second coupling members 320 between the engaged and disengaged conditions it is necessary to move the top cover 210(C) along a direction substantially parallel to direction x. Indeed, if the top cover 210(C) was moved along a different direction, e.g., along direction z, the cantilevered elements of the second coupling members 320 would not be able to enter into/exit from the slits 330.

In the embodiment of the invention illustrated in the figures, wherein two second coupling members 320 are provided, two corresponding slits 330 are located on a wall located between the multi-dose compartments 220(1), 220 (2) and the mono-dose compartments 230(1), 230(2).

According to a different embodiment of the invention (not illustrated), the second coupling members 320 comprise slits adapted to receive corresponding cantilevered elements located on the drawer 115, for example cantilevered elements protruding from the wall located between the multi-dose compartments 220(1), 220(2) and the mono-dose compartments 230(1), 230(2).

According to an embodiment of the present invention, the first and second coupling members 310, 320 are preferably located on opposite ends of the top cover 210(C), respectively. In the embodiment of the invention illustrated in the figures, the first coupling member 310 is preferably located at a rear end of the top cover 210(C) which is configured to be located at the rear portion of the drawer 115 when the top cover 210(C) is coupled to the drawer 115 (so that the snap-fitting portion 310(S) of the first coupling member 310 is able to engage a portion of the wall preferably located between the multi-dose compartments 220(1), 220(2) and the channels 215(1), 215(2)). In the embodiment of the invention illustrated in the figures, the second coupling members 320 are located at a front end of the top cover 210(C) opposite to the rear end (so that the cantilevered elements of the second coupling members 320 are able to be received in the slits 330 preferably located on the wall between the multi-dose compartments 220(1), 220(2) and the mono-dose compartments 230(1), 230(2)). This configuration is particularly advantageous since in order to being able to reach the (release portion 310(R) of the) first coupling member 310, an user is forced to entirely detach the drawer 115 from the drawer seat 120, avoiding thus that a partially decoupled top cover 210(C) get stuck within the drawer seat 120. In any case, the concepts of the present invention can be also applied in case the positions of the first and second coupling members 310, 320 are switched, and/or if at least one first and/or second coupling member 310 is provided at lateral sides of the top cover 210(C) (i.e., at the sides thereof which substantially extend along direction x).

According to an embodiment of the present invention, in order to couple the top cover 210(C) to the drawer 115, the second coupling members 320 preferably have to be switched to the engaged condition (i.e., the cantilevered elements thereof have to be inserted inside the corresponding slits 330) while the first coupling member 310 is still in the disengaged condition (i.e., with the snap-fitting portion 310(S) that it is still disengaged from any portion of the drawer 115). Indeed, as already mentioned above, the only way to allow the top cover 210(C) to enter into/exit from the slits 330 is to move the top cover 210(C) along a direction substantially parallel to direction x; if the if the first coupling member 310 was switched to the engaged condition (i.e., by having the snap-fitting portion 310(S) which is engaging a portion of the drawer 115) before the second coupling members 320 is switched to the engaged condition, this movement along a direction parallel to direction x would not possible, because the top cover 210(C) would be already bound to the drawer 115 on the other side through the first coupling member 310.

According to an embodiment of the present invention, the second coupling members 320 are preferably configured such that, when they are in the engaged condition (i.e., when the cantilevered elements thereof are inserted inside the corresponding slits 330), and at the same time the first coupling member 310 is in the disengaged condition (i.e., with the snap-fitting portion 310(S) that it is disengaged from any portion of the drawer 115), the top cover 210(C) is allowed to be moved with respect to the drawer 115 with the second coupling members 320 acting as a fulcrum.

According to an embodiment of the present invention, this is obtained by having the slits 330 shaped in such a way that, when the second coupling members 320 are in the engaged condition (i.e., when the cantilevered elements thereof are inserted inside the slits 330), a slit/cantilevered element mechanical play is left to allow a rotation of the top cover 210(C) with respect to the drawer 115 while the first coupling member 310 is in the disengaged condition.

Compared to the known solutions, the coupling system according to the embodiments of the present invention described above is handy and does not require long and cumbersome operations to be carried out by the user when trying to couple/decouple the top cover 210(C) to/from the drawer 115.

Indeed, in order to couple the top cover 210(C) to the drawer 115 starting from a situation in which both the first and second coupling members 310, 320 are in the disengaged condition, it is sufficient to perform the following sequence of operations:

- switching the second coupling members 320 into the engaged condition (e.g., by moving the top cover 210(C) substantially along direction x to insert the cantilevered elements inside the corresponding slits 330);
- moving (rotating) the top cover 210(C) with respect to the drawer 115 around the second coupling members 320 until the top cover 210(C) covers at least partially the top openings of the compartments;
- switching the first coupling member 310 into the engaged condition.

In order to decouple the top cover 210(C) from the drawer 115, i.e., starting from the situation in which both the first and second coupling members 310, 320 are in the engaged condition, it is sufficient to perform the following sequence of operations:

- switching the first coupling member 310 from the engaged to the disengaged condition by operating the release portion 310(R);
- moving the top cover 210(C) with respect to the drawer 115 around the second coupling members 320 to uncover the top openings of the compartments;
- switching the second coupling member 320 into the disengaged condition (e.g., by moving the top cover 210(C) substantially along direction x to extract the cantilevered elements from the corresponding slits 330).

Since these operations are very intuitive and easy to be carried out, they can be carried out quite quickly, usually accomplishing the desired decoupling or coupling at the first attempt, reducing thus the wear the first and second coupling members 310, 320 are subjected to.

According to an embodiment of the present invention, the borders of the multi-dose compartments 220(1), 220(2) advantageously comprises seats or recesses 340 (see for example FIGS. 2B and 3A) adapted to receive borders of the top cover 210(C) when the top cover 210(C) is coupled to the drawer 115.

According to an embodiment of the invention, the top cover 210(C) preferably comprises wall members 360 (Only one visible in FIGS. 3A and 3C), each one downwardly protruding from the inner side of the top cover 210(C) and surrounding from below a respective one between the abovementioned two access apertures (not shown) located on the top cover 210(C), and downwardly extending from the top cover 210(C) into the respective multi-dose compartment 220(1), 220(2) when the top cover 210(C) is coupled to the drawer 115. The wall members 360 are advantageously used for guiding the flow of the laundry treatment agent into the multi-dose compartment 220(1), 220(2) when the laundry treatment agent is poured from outside by an user to refill said multi-dose compartment 220(1), 220(2).

According to an embodiment of the present invention, the top cover 210(C) is preferably provided with a wave breaking system which is configured to break waves which can be formed at the surface of the laundry treatment agent contained in at least one of the multi-dose compartments 220(1), 220(2) when the drawer 115 is moved along the sliding direction between the extracted and retracted positions because of the accelerations the drawer 115 is subjected to during such movements. For this purpose, according to an embodiment of the present invention, the top cover 210(C) further comprises at least one breaking wall member 370 comprising a wall which downwardly extends from the (inner side of the) top cover 210(C) into one of the multi-dose compartments 220(1), 220(2) when the top cover 210(C) is coupled to the drawer 115.

According to an embodiment of the present invention, the wave breaking system preferably comprises two wave breaking wall members 370 (Only one visible in FIGS. 3A and 3C) each one comprising a wall substantially extending along direction z and which downwardly protrudes from a portion of the inner side of the top cover 210(C) which preferably is rearward with respect to the access apertures (and therefore rearward with respect to the wall members 360 as well) when the top cover 210(C) is coupled to the drawer 115.

According to an embodiment of the present invention, each one of the wave breaking wall members 370 preferably exhibits at least one breaking surface which is arranged to oppose itself against the propagation direction of waves which could be formed at the surface of the laundry treatment agent contained in the multi-dose compartments 220(1), 220(2) when the drawer 115 is moved between the extracted position and the retracted position. For example, according to an embodiment of the invention, such breaking surface may extend substantially perpendicularly to the sliding direction.

In the same way, each one of the wave breaking wall members 370 preferably defines a free area between said wave breaking wall member 370 and one of the walls of the multi-dose compartments 220(1), 220(2) around the periphery of the wave breaking wall member 370. In this way, a gap is left for allowing the laundry treatment agent contained in the multi-dose compartments 220(1), 220(2) to flow past and around the wave breaking wall members 370. In the considered example, the wave breaking wall members 370 have such a length that they do not reach the bottom wall of the multi-dose compartments 220(1), 220(2) and such a width that they do not reach lateral walls of the multi-dose compartment multi-dose compartments 220(1), 220(2).

Naturally, similar considerations apply in case the number, shape, and the position of the wave breaking wall members is different.

It has to be appreciated that also the wall members 360 surrounding from below the access apertures of the top cover 210(C) can be used as wave breaking wall members, since, like the wave breaking wall members 370, they exhibit at least one breaking surface arranged to oppose itself against the propagation direction of waves which could be formed at the surface of the laundry treatment agent.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. A laundry appliance, comprising:

a cabinet accommodating a laundry treatment chamber; and a drawer configured to slide with respect to the cabinet along a sliding direction, the drawer comprising:

at least one compartment configured to contain a laundry treatment agent to be selectively provided to the laundry treatment chamber, the at least one compartment being provided with a top opening for the loading of the laundry treatment agent from above, a top cover adapted to cover at least partially the top opening of the at least one compartment, the top cover comprising at least one first coupling member and at least one second coupling member each one of the at least one first coupling member and at least one second coupling member being configured to be switched between a respective engaged condition in engagement with the drawer and a respective disengaged condition not in engagement with the drawer, wherein the top cover is firmly coupled to the drawer when both the at least one first coupling member and the at least one second coupling member are in the respective engaged condition, wherein:

the at least one second coupling member is configured such that, when the at least one first coupling member is in the respective disengaged condition, and at the same time the at least one second coupling member is in the respective engaged condition, the top cover is allowed to be moved with respect to the drawer with the at least one second coupling member acting as a fulcrum, and the first and second coupling members are configured to:

prevent the at least one second coupling member from switching from the respective disengaged condition to the respective engaged condition when the at least one first coupling member is in the respective engaged condition; and allow the at least one second coupling member to switch from the respective disengaged condition to the respective engaged condition when the at least one first coupling member is in the respective disengaged condition.

2. The laundry appliance of claim 1, wherein the at least one first coupling member comprises a respective snap-fitting portion adapted to engage a respective drawer portion in the respective engaged condition and a release portion operable by a user to switch the at least one first coupling member to the respective disengaged condition by releasing the snap-fitting portion from the corresponding drawer portion.

3. The laundry appliance of claim 1, wherein:

the at least one second coupling member comprises a respective cantilevered element, and the drawer further comprises at least one slit adapted to receive the cantilevered element of a respective second coupling member when the second coupling member is in the respective engaged condition.

4. The laundry appliance of claim 3, wherein the slit is shaped in such a way that, when the at least one first coupling member is in the respective disengaged condition and at the same time the at least one second coupling member is in the respective engaged condition, a slit/cantilevered element mechanical play is left to allow a rotation of the top cover with respect to the drawer.

5. The laundry appliance of claim 1, wherein the at least one first coupling member and the at least one second coupling member are located on opposite ends of the top cover.

6. The laundry appliance of claim 1, wherein the drawer comprises a drawer rear portion and an opposite drawer front portion, the drawer being configured to slide with respect to the cabinet along the sliding direction between:

a retracted position, in which the drawer is retracted inside cabinet, and an extracted position, in which the drawer is at least partially extracted from the cabinet and the drawer front portion externally protrudes from the cabinet front, wherein:

a selected one between the at least one first coupling member and the at least one second coupling member is located at a rear end of the top cover located at the rear portion of the drawer when the top cover is coupled to the drawer.

7. The laundry appliance of claim 6, wherein the at least one first coupling member is located at the rear end of the top cover and the at least one second coupling member is located at a front end of the top cover opposite to the rear end.

8. The laundry appliance of claim 6, wherein the drawer comprises, from the drawer front portion and along the sliding direction:

a handle forming the drawer front;

behind the handle, at least one compartment configured to contain multiple doses of the laundry treatment agent;

behind the at least one compartment, at least one channel associated with the at least one compartment and configured to channel water and at least one dose of the laundry treatment agent towards a mixing region allowing a mixture between the water and the at least one laundry treatment agent dose;

behind the at least one channel, at least one pump actuation part having a suction side in fluid communication with the at least one compartment and configured to draw up the at least one laundry treatment agent dose therefrom, and a delivery side in fluid communication with the at least one channel configured to deliver the at least one treatment agent dose thereto, wherein:

the at least one first coupling member is configured to engage a portion of a wall between the at least one compartment and the at least one channel when the at least one first coupling member is in the respective engaged condition.

9. The laundry appliance of claim 1, wherein the top cover comprises one or more access apertures, in fluid communication with a respective one of the at least one compartment for allowing the laundry treatment agent to be loaded therein when the top cover is coupled to the drawer.

10. The laundry appliance of claim 9, wherein the top cover further comprises at least one wall member surrounding from below a respective one access aperture and downwardly extending from the top cover into the respective compartment when the top cover is coupled to the drawer.

11. The laundry appliance of claim 1, wherein respective borders of the at least one compartment comprise seats configured to receive respective borders of the top cover when the top cover is coupled to the drawer.

12. The laundry appliance of claim 1, wherein the top cover comprises at least one breaking wall member comprising a wall that downwardly extends from the top cover into one of the at least one compartment when the top cover is coupled to the drawer, the breaking wall member being configured to break for broking waves forming in the laundry treatment agent contained in the at least one compartment when the drawer is moved along the sliding direction.

13. A laundry appliance, comprising:

a cabinet; and a drawer configured to slide with respect to the cabinet along a sliding direction, the drawer comprising:

at least one compartment configured to contain a laundry treatment agent, the at least one compartment being provided with a top opening for the loading of the laundry treatment agent from above, a top cover adapted to cover at least partially the top opening of the at least one compartment, the top cover comprising at least one first coupling member and at least one second coupling member, each one of the at least one first coupling member and at least one second coupling member being configured to be switched between a respective engaged condition in engagement with the drawer and a respective disengaged condition not in engagement with the drawer, wherein the top cover is firmly coupled to the drawer when both the at least one first coupling member and the at least one second coupling member are in the respective engaged condition, wherein:

the at least one second coupling member comprises a cantilevered element, and the drawer further comprises at least one slit adapted to receive the cantilevered element of the respective second coupling member when the second coupling member is in the respective engaged condition, and the first and second coupling members are configured to:

prevent the at least one second coupling member from switching from the respective disengaged condition to the respective engaged condition when the at least one first coupling member is in the respective engaged condition; and allow the at least one second coupling member to switch from the respective disengaged condition to the respective engaged condition when the at least one first coupling member is in the respective disengaged condition.

14. The laundry appliance of claim 13, wherein the slit is shaped in such a way that, when the at least one first coupling member is in the respective disengaged condition and at the same time the at least one second coupling member is in the respective engaged condition, the top cover is allowed to rotate with respect to the drawer.

15. The laundry appliance of claim 13, wherein the at least one first coupling member and the at least one second coupling member are located on opposite ends of the top cover.

16. The laundry appliance of claim 13, wherein the top cover comprises at least one breaking wall member comprising a wall that downwardly extends from the top cover into the at least one compartment when the top cover is coupled to the drawer.

17. A laundry appliance, comprising:

a cabinet; and a drawer configured to slide with respect to the cabinet along a sliding direction, the drawer comprising:

at least one compartment configured to contain a laundry treatment agent, the at least one compartment being provided with a top opening for the loading of the laundry treatment agent from above, a top cover adapted to cover at least partially the top opening of the at least one compartment, the top cover comprising at least one first coupling member and at least one second coupling member, each one of the at least one first coupling member and at least one second coupling member being configured to be switched between a respective engaged condition in engagement with the drawer and a respective disengaged condition not in engagement with the drawer, wherein the top cover is firmly coupled to the drawer when both the at least one first coupling member and the at least one second coupling member are in the respective engaged condition, wherein:

the drawer comprises a drawer rear portion and an opposite drawer front portion, the drawer being configured to slide with respect to the cabinet along the sliding direction between:

a retracted position, in which the drawer is retracted inside cabinet, and an extracted position, in which the drawer is at least partially extracted from the cabinet and the drawer front portion externally protrudes from the cabinet front, the at least one first coupling member or the at least one second coupling member is located at the rear portion of the drawer when the top cover is coupled to the drawer, and the first and second coupling members are configured to:

prevent the at least one second coupling member from switching from the respective disengaged condition to the respective engaged condition when the at least one first coupling member is in the respective engaged condition; and allow the at least one second coupling member to switch from the respective disengaged condition to the respective engaged condition when the at least one first coupling member is in the respective disengaged condition.

18. The laundry appliance of claim 17, wherein the at least one first coupling member is located at the rear portion of the drawer.

19. The laundry appliance of claim 17, wherein the at least one first coupling member and the at least one second coupling member are located on opposite ends of the top cover.

20. The laundry appliance of claim 17, wherein the drawer comprises:

a handle forming the drawer front;

at least one compartment configured to contain multiple doses of the laundry treatment agent; and at least one channel associated with the at least one compartment and configured to channel water and at least one dose of the laundry treatment agent towards a mixing region allowing a mixture between the water and the at least one laundry treatment agent dose.

* * * * *